US005664598A

United States Patent [19]

Shieh

[11] Patent Number: 5,664,598

[45] Date of Patent: Sep. 9, 1997

[54] SAFETY VALVE

[76] Inventor: Ming-Don Shieh, No. 18, Tou Ren Lane, Tou Ren Li, Lu Gang Town, Chang Hua Hsien, Taiwan

[21] Appl. No.: 496,060

[22] Filed: Jun. 28, 1995

[51] Int. Cl.[6] ..... G05D 11/03

[52] U.S. Cl. ..... 137/100; 137/607

[58] Field of Search ..... 137/100, 114, 137/607

[56] References Cited

U.S. PATENT DOCUMENTS

| | | | |
|---|---|---|---|
| 1,948,044 | 2/1934 | Myers et al. | 137/100 |
| 2,009,102 | 7/1935 | Bern | 137/100 |
| 4,923,092 | 5/1990 | Kirschner et al. | 137/100 X |
| 5,425,394 | 6/1995 | Clare | 137/100 X |

FOREIGN PATENT DOCUMENTS

| | | | |
|---|---|---|---|
| 867124 | 5/1961 | United Kingdom | 137/100 |

*Primary Examiner*—Stephen M. Hepperle
*Attorney, Agent, or Firm*—Charles E. Baxley, Esq.

[57] ABSTRACT

A valve includes a chamber and two inlets for supplying cold and hot water into the chamber. A membrane is secured in the chamber so as to separate the inlets from each other. Two plugs are engaged in the inlets and secured to the membrane for blocking the inlets. Two springs are engaged on the plugs for balancing the membrane and the plugs. One of the plugs is forced to block one of the inlet when no water is supplied from the other inlet, so as to prevent the users from being hurt by hot water.

6 Claims, 2 Drawing Sheets

SAFETY VALVE

BACKGROUND OF THE INVENTION

1. Field of the Invention

The present invention relates to a safety valve, and more particularly to a three-way valve having a safety mechanism.

2. Description of the Prior Art

Typical three-way valves comprise two inlets coupling to cold water and hot water respectively and an outlet communicating with the two inlets for receiving the cold water and hot water from the inlets simultaneously. However, when the cold water is cut-off suddenly or is turned off inadvertently, the hot water may hurt the users.

The present invention has arisen to mitigate and/or obviate the afore-described disadvantages of the conventional three-way valves.

SUMMARY OF THE INVENTION

The primary objective of the present invention is to provide a valve which includes a safety mechanism provided therein for preventing hot water from flowing out of the outlet without mixing with cold water.

In accordance with one aspect of the invention, there is provided a valve comprising a body including a chamber formed therein and including two inlets communicating with the chamber, and including two rooms communicating with the inlets, and including an outlet communicating with the rooms for receiving water from the inlets, the inlets each including a valve seat provided therein, a membrane secured in the chamber so as to separate the inlets from each other, two plugs engaged in the inlets and secured to the membrane, the plugs being provided for engaging with the valve seats so as to block the inlets respectively, and two biasing means engaged on the plugs and biased between the membrane and the body for balancing the membrane and the plugs. The water from the inlets are combined in the outlet via the rooms, a first of the plugs being forced to engage with the valve seat of a first of the inlets by water from the first inlet when no water is supplied to a second of the inlets.

The chamber includes a peripheral surface having an annular groove formed therein for engaging with a peripheral portion of the membrane so as to separate the inlets from each other.

A ring is secured to the membrane and includes a bore for engaging with the plugs, the biasing means are biased between the membrane and the body for balancing the membrane and the plugs.

The first plug includes an orifice formed therein and includes an annular protrusion formed therein, a second of the plugs includes a Projection for engaging in the orifice of the first plug and includes an annular shoulder for engaging with the annular protrusion so as to secure the plugs together.

The annular protrusion of the first plug includes a tapered surface for facilitating engagement of the projection with the orifice. The projection of the second plug includes an oblong hole formed therein for facilitating engagement of the projection with the orifice. The plugs each includes an annular flange for engaging with the ring so as to stably secure the plugs to the ring and the membrane.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
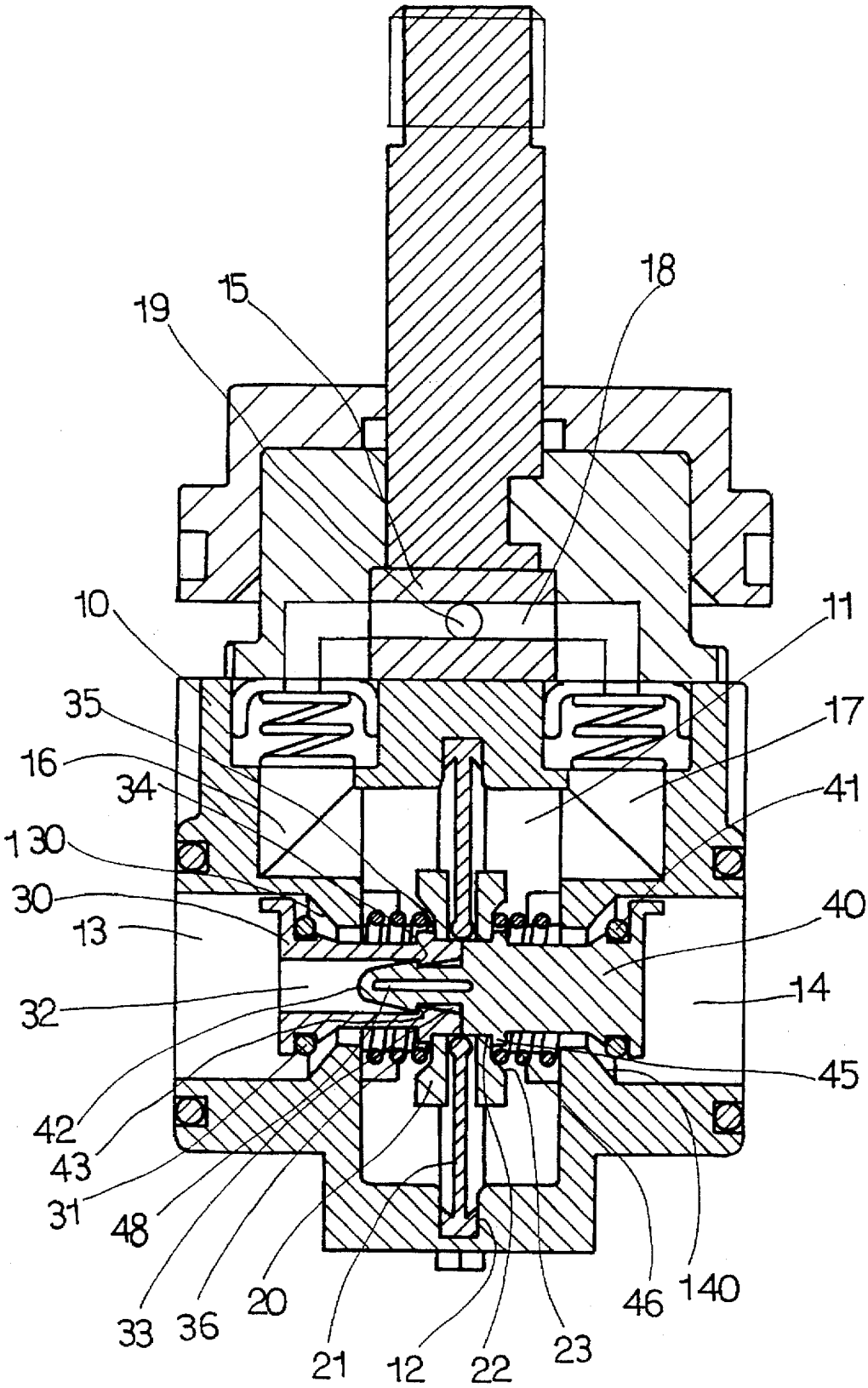
FIGS. 1 and 2 are cross sectional views of the safety valve in accordance with the present invention, illustrating the operation of the safety valve.

Referring to the drawings, and initially to FIG. 1, a safety valve in accordance with the present invention comprises a body 10 including a chamber 11 formed therein and including two inlets 13, 14 communicating with the chamber 11 for receiving cold water and hot water respectively. The inlets 13, 14 each includes a tapered valve seat 130, 140 provided therein. The chamber 11 includes a peripheral surface having an annular groove 12 formed therein for engaging with the peripheral portion of a membrane 21 which separates the chamber 11 into two spaces for communicating with the inlets 13, 14 respectively. The body 10 includes two rooms 16, 17 formed therein and communicating with the inlets 13, 14 respectively. The body 10 further includes a valve member 15 having a passageway 18 for communicating with the rooms 16, 17 and having an outlet 19 connected with the passageway 18 for receiving and for combining the cold water and the hot water from the inlets 13, 14.

Two plugs 30, 40 are provided in the inlets 13, 14 respectively and each includes a sealing ring 31, 41 engaged thereon for engaging with the valve seats 130, 140 so as to block the inlets 13, 14 respectively. A ring 20 is secured in the center portion of the membrane 21 and includes a bore 22 for engaging with the plugs 30, 40, and includes two side surfaces each having a recess 23 formed therein for engaging with spring members 36, 46 respectively. The plug 30 includes an orifice 32 formed therein for engaging with a projection 42 of the other plug 40; and includes an annular protrusion 34 formed thereon for engaging with an annular shoulder 43 of the projection 42 so as to secure the plugs 30, 40 together. The annular protrusion 34 includes a tapered surface 33 for facilitating the engagement of the projection 42 into the orifice 32 of the plug 30. The plugs 30, 40 each includes an annular flange 35, 45 for engaging with the ring 20 so as to stably secure the plugs 30, 40 to the ring 20. It is preferable that the projection 42 includes an oblong hole 48 formed therein so as to facilitate the engagement of the projection 42 into the orifice 32 of the plug 30. The springs 36, 46 are biased between the ring 20 and the body 10 and are balanced so as to retain the ring 20 and the membrane 21 in the center portion of the space 11.

Figure 2:
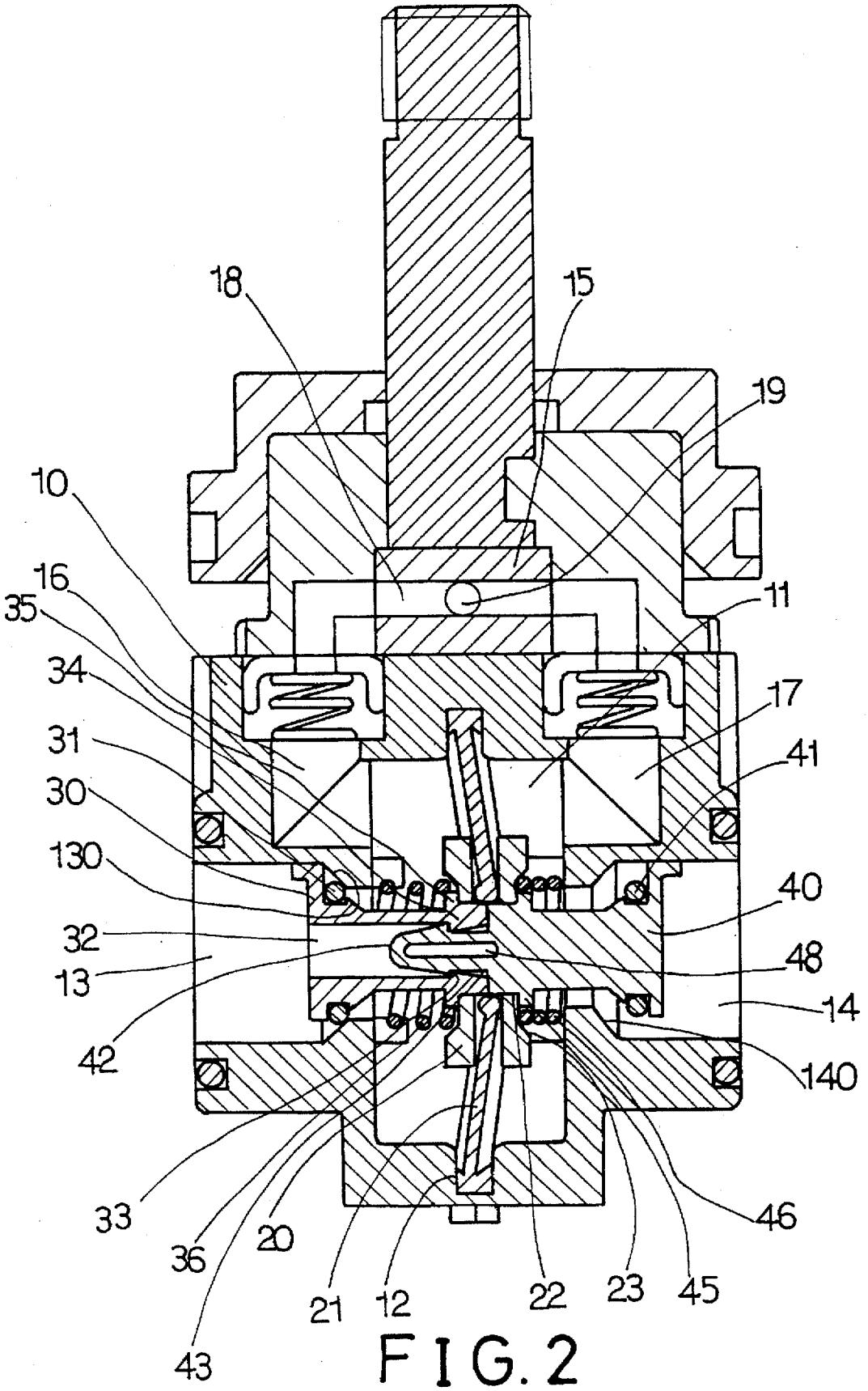

In operation, as shown in FIG. 2, the inlets 13, 14 are provided for receiving hot water and cold water respectively, for example. When the cold water from the inlet 14 is cut off, no water pressure will be applied onto the plug 40. At this moment, the hot water from the inlet 13 may apply a force onto the plug 30 in order to force the plug 30, against the spring 36, to engage with the valve seat 130 and so as to cut off the hot water and in order to prevent the hot water from hurting the users.

Accordingly, the safety valve in accordance with the present invention includes two plugs that may block one of the inlets when the water from the other inlet is cut off, in order to prevent the users from being hurt by hot water.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A valve comprising:

a body including a chamber formed therein and including inlets communicating with said chamber, and including two rooms communicating with said inlets, and including an outlet communicating with said rooms for receiving water from said inlets, said inlets each including a valve seat provided therein, a membrane secured in said chamber so as to separate said inlets from each other, two plugs engaged in said inlets and secured to said membrane, said plugs being provided for engaging with said valve seats so as to block said inlets respectively, two biasing means engaged on said plugs and biased between said membrane and said body for balancing said membrane and said plugs, and a ring secured to said membrane, said ring including a bore for engaging with said plugs, said biasing means being biased between said membrane and said body for balancing said membrane and said plugs, water from said inlets being combined in said outlet via said rooms, a first of said plugs being forced to engage with said valve seat of a first of said inlets by water from said first inlet when no water is supplied to a second of said inlets.

2. A valve according to claim 1, wherein said chamber includes a peripheral surface having an annular groove formed therein for engaging with a peripheral portion of said membrane so as to separate said inlets from each other.

3. A valve according to claim 1, wherein said first plug includes an orifice formed therein and includes an annular protrusion formed therein, a second of said plugs includes a projection for engaging in said orifice of said first plug and includes an annular shoulder for engaging with said annular protrusion so as to secure said plugs together.

4. A valve according to claim 3, wherein said annular protrusion of said first plug includes a tapered surface for facilitating engagement of said projection with said orifice.

5. A valve according to claim 3, wherein said projection of said second plug includes an oblong hole formed therein for facilitating engagement of said projection with said orifice.

6. A valve according to claim 3, wherein said plugs each includes an annular flange for engaging with said ring so as to stably secure said plugs to said ring and said membrane.

* * * * *